United States Patent [19]

Dorsey

[11] 4,404,713

[45] Sep. 20, 1983

[54] CLUTCH USING PARTIAL VACUUM TO RESIST SEPARATION

[76] Inventor: Edmund Dorsey, 455 Meschanticut Valley Pkwy., Cranston, R.I. 02920

[21] Appl. No.: 327,887

[22] Filed: Dec. 7, 1981

[51] Int. Cl.[3] ..... A44B 17/00

[52] U.S. Cl. ..... 24/217 R; 24/155 SD; 411/44; 411/512

[58] Field of Search ..... 24/155 SD, 217 R, 216, 24/208 R, 208 A; 411/44, 63, 16–18, 360, 512

[56] References Cited

U.S. PATENT DOCUMENTS

| | | | |
|---|---|---|---|
| 986,874 | 3/1911 | Thomlinson et al. | 24/155 SD |
| 2,040,289 | 5/1936 | Adams | 24/155 SD X |
| 3,118,644 | 1/1964 | Wernig | 24/208 A X |
| 3,905,525 | 9/1975 | Kawamata | 24/217 R X |

FOREIGN PATENT DOCUMENTS

| | | | |
|---|---|---|---|
| 813487 | 2/1937 | France | 24/217 |
| 64986 | 5/1913 | Switzerland | 24/155 SD |
| 546133 | 6/1942 | United Kingdom | 24/217 |

*Primary Examiner*—F. Barry Shay
*Attorney, Agent, or Firm*—Barlow & Barlow, Ltd.

[57] ABSTRACT

A clutch is disclosed consisting of two parts, the first part being a tubular shell closed at one end, the shell having therein a resilient female clutch member that is held in position by lips on the open end of the shell. A male member is provided which is adapted to be received within the resilient member. The resilient member within the shell is cylindrical of a longitudinal dimension less than the space within the shell and of an outside diameter less than the inside diameter of the shell. The male member is made of a size so that the sum of its diameter plus the wall thickness of the resilient clutch member is greater than the inside diameter of the tubular shell, so as to create an airtight joint when the male member is inserted within the resilient member, but yet permitting air to escape around the outside of the resilient member and retarded only when disengagement is attempted, at which time the resilient clutch member will seal against the lip of the tubular shell.

3 Claims, 3 Drawing Figures

CLUTCH USING PARTIAL VACUUM TO RESIST SEPARATION

BACKGROUND OF THE INVENTION

Clutches or jewelry clasps are commonly made up with a female member and a complimentary male member. One common form of clutch is what is known as a box clutch which is used for fastening the ends of necklaces together and is of a type exemplified, as for example, in U.S. Pat. No. 2,986,792. There are also a plurality of pin stem clutches utilizing resilient gripping material, as for example, as disclosed in U.S. Pat. No. 3,945,089, and necklace clutches with resilient inserts as seen in U.S. Pat. No. 3,066,501. Where resilient material is used inside of a body to grip a male member, the resilient material is firmly held within the body and is deformed by the male member. The holding power of a device of this nature is therefore dependent solely on the elasticity of the resilient piece.

Accordingly, it is an object of this invention to provide an improved clutch construction which is based on the utilization of male and female members, and a resilient clutch member retained in a cavity in such a way that when withdrawal is attempted, a partial vacuum is created that develops considerable resistance to removal of the male member.

According to this invention the clutch is formed of two parts, one being a tubular shell which is closed at one end so as to form in effect an open cavity in which a resilient tubular clutch member is retained. The resilient tubular clutch is specifically formed in such a way that its outside diameter is less than the inside diameter of the tubular shell cavity; and further, the resilient tubular clutch member has a longitudinal dimension less than the longtudinal dimension of the shell cavity, so that in effect, the tubular clutch is free to slide within the tubular shell and accordingly must be maintained therein by the provision of a lip at the mouth of the open cavity. Cooperating with the tubular shell is a stud which has a diameter larger than the inner diameter of the clutch member and is, of course, adapted to be inserted and withdrawn from the female clutch member. The sizing of the stud is such that the resilient clutch member will expand toward the wall of the shell and will allow the release of displaced air as the stud member is pushed further inwardly. When the stud is attempted to be withdrawn, the resilient clutch member will slide toward the lip at the open mouth of the cavity in the tubular shell and seal against the lip so that in effect, a vacuum is created in the cavity as further withdrawal is attempted. A clutch member therefore does not depend upon the resilience of the material that is used as a clutch member, but by the sealing thereof of the stud into the shell so that as withdrawal is attempted, a vacuum is created.

DESCRIPTION OF THE PREFERRED EMBODIMENT

Figure 1:
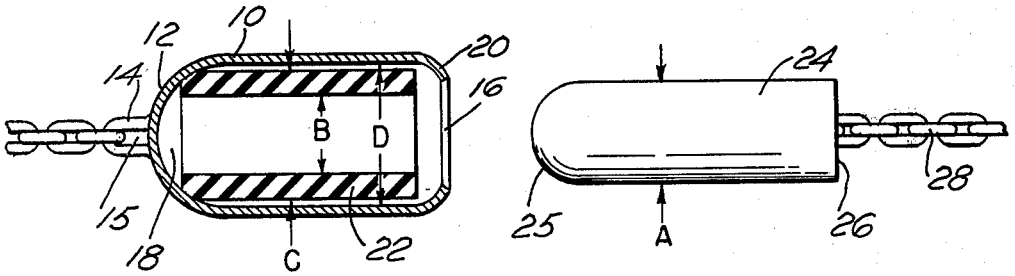
FIG. 1 is a detached sectional view showing the two-part clutch of the invention.

The clutch of this invention includes a tubular shell 10 which is closed at one end 12 to which an ear 14 is affixed having an aperture 15 therein. The tubular shell 10 has a mouth as at 16 which opens into a cavity 18 and at the mouth, the opening has an inturned lip 20 that is formed by rolling the end of the shell inwardly.

Within cavity 18 there is received a resilient tubular clutch member 22, and it will be noted by referring to the drawing that the clutch member 22 is of a longitudinal dimension less than the longitudinal dimension of the cavity 18, and is of a diameter less than the inner diameter of the cavity 18.

Cooperating with the tubular member 10 is a stud 24 which has a blunt nose 25 and a rearward portion 26 to which a chain 28 may be soldered or otherwise affixed. The stud can take a variety of forms, as for example, it can be a hollow tubular portion into which the chain may be soldered, or it may be a solid piece. The dimension "A" of the stud, which is the diameter thereof, is greater than the inner diameter "B" of the resilient member 22. Further, the outer diameter "C" of the resilient member 22 is less than the inner diameter "D" of the tubular shell 10.

Figure 2:
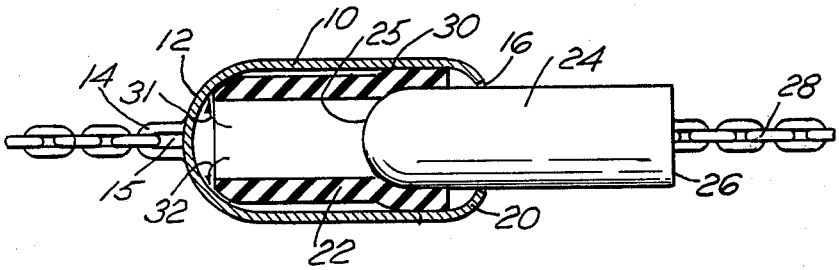
FIG. 2 is a sectional view showing a first stage of insertion of a stud into the clutch.

Referring now to FIG. 2, it will be seen that the stud 24 has been inserted into the mouth 16 of the tubular shell and the resilient member has been expanded so as to slightly contact the inner wall of the cavity 18 as at 30. As the stud progresses inwardly, the displaced air will exhaust as seen by the arrows 31, 32 out along the periphery of the resilient member 22 and will pass out through the mouth 16. When the stud 24 is completely inserted into the tubular shell, the resilient member will have been expanded substantially against the inner wall of the cavity 18 and as withdrawal is attempted in the direction as seen by the arrow 34, the resilient member 22 will move to the right as seen in the drawing to seal itself against the lip 20. Further withdrawal of the stud will be inhibited by the fact that a vacuum builds up within the cavity 18, there being little possibility of air entering the cavity to equalize the pressure therein, and accordingly, the amount of pull that is necessary on the stud is increased. By way of example, if the dimension "A" is 0.100 inch, then dimension "B" is 0.078 inch, plus or minus 0.004; and the dimension "D" is 0.150 inch. It has been found that it will be necessary to use at least 18 ounces of pull before the stud will release. This is the condition when the stud is fully inserted into the resilient clutch member which had a longitudinal dimension of 0.750 inch. To further understand the increase in the amount of pull which is caused by the partial vacuum that is developed, if one inserted the stud 24 0.200 inch tests have revealed that it takes 18 ounces of pull before the stud will break loose. It will accordingly be recognized that by increasing the length of the resilient member 22 and, of course, the length of the cavity 18, you can increase the holding power. Similarly, the inverse would be true.

Figure 3:
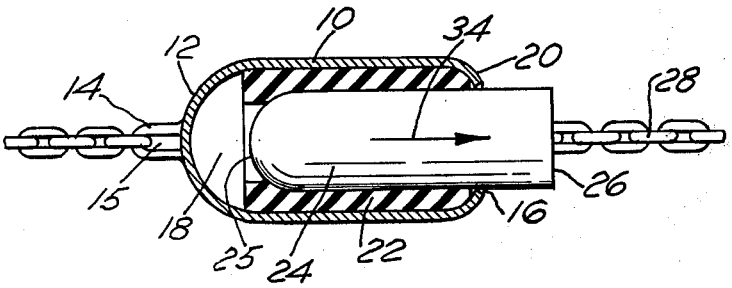
FIG. 3 is a sectional view showing the stud fully inserted with a force being applied thereto as shown by the arrow attempting to pull the two parts apart.

It should further be recognized that when the resilient member 22 compresses as the stud is being inserted therein, that it does not compress linearly so that while in the example given the wall thickness of the resilient member 22 was approximately 0.027 inch and the addition of the figures indicate that a fully inserted structure as seen in FIG. 3 of the drawings would appear to indicate that the stud 24 plus the resilient member 22 would tightly engage the inner wall of the cavity 18. This is not indeed, so due to the longitudinal deformation of the resilient member 22 and the restricted cellular compression of the member to within the shell which effectively thins out the wall of the member 22.

I claim:

1. A clutch comprising a tubular shell closed at one end to define an open cavity, a resilient, stretchable, tubular clutch member having a through bore and an outer transverse dimension smaller than the inner transverse dimension of the cavity loosely retained in the cavity, a stud of a transverse dimension larger than the inner transverse dimension of the clutch member and adapted to be inserted and withdrawn from the clutch member with the external and internal surfaces, respectively, of said stud and clutch member in sealing relation to each other, whereby the resilient clutch member expands in said shell during insertion of said stud, yet allows release of displaced air from said shell, said shell having peripheral lip means at the open end of the cavity and being imperforate except for said open end whereby, as the stud is withdrawn, the clutch member seals against the lip means and a partial vacuum occurs thereby resisting disengagement.

2. A clutch as in claim 1 wherein the shell has an ear at the closed end for attaching a device thereto.

3. A clutch as in claim 1 wherein the stud is tubular and a second device is attached to the tubular structure.

* * * * *